US005746332A

United States Patent [19]

Kleinschmidt

[11] Patent Number: 5,746,332

[45] Date of Patent: May 5, 1998

[54] TRANSPARENT SHELF FOR DISPLAY ASSEMBLY

[76] Inventor: Roger E. Kleinschmidt, 5303 Park Place Cir., Boca Raton, Fla. 33486-1062

[21] Appl. No.: 820,975

[22] Filed: Mar. 19, 1997

[51] Int. Cl.[6] ..... A47F 7/00

[52] U.S. Cl. ..... 211/153; 211/14; 108/25; D6/552

[58] Field of Search ..... 211/14, 153, 72, 211/73, 90.01, 90.04; 108/25; D6/552

[56] References Cited

U.S. PATENT DOCUMENTS

| | | | |
|---|---|---|---|
| D. 314,111 | 1/1991 | Ohno | D6/552 |
| D. 366,584 | 1/1996 | Ellis | D6/552 |
| 3,198,338 | 8/1965 | McCormick | 211/14 |
| 3,774,774 | 11/1973 | Menkel | 211/72 |
| 4,103,773 | 8/1978 | Haber | 211/14 X |
| 4,524,968 | 6/1985 | Dolp | 211/14 X |
| 4,892,197 | 1/1990 | Slatteny et al. | 211/14 |
| 4,955,485 | 9/1990 | Alton | 211/14 |
| 5,195,633 | 3/1993 | Kaminski | 211/14 X |
| 5,413,228 | 5/1995 | Le Clerc | 211/14 X |

*Primary Examiner*—Robert W. Gibson, Jr.
*Attorney, Agent, or Firm*—Robert M. Downey, P.A.

[57] ABSTRACT

A shelf for use in a display assembly for displaying one or more objects, such as sports balls, wherein the display assembly includes a main panel with a front face having one or more horizontal grooves formed therein. The shelf is formed of a transparent plastic material and includes dish-like cradles disposed at spaced intervals along the top side for holding the objects on the shelf. Transverse reinforcing ribs on opposite sides of each cradle provide strength and rigidity to the shelf. The ribs further provide an increased thickness to the shelf, creating a snug friction fit of a rear peripheral zone within the groove in the back panel, so that the shelf is held in perpendicular relation to the front face of the panel, defining an installed position, whereby the objects are supported within the cradles in a preferred viewing orientation for display. A series of shelves may be fitted to the main panel, in spaced parallel relation to display the objects in a vertically aligned or honeycomb like stacked arrangement.

12 Claims, 2 Drawing Sheets

FIG. 3
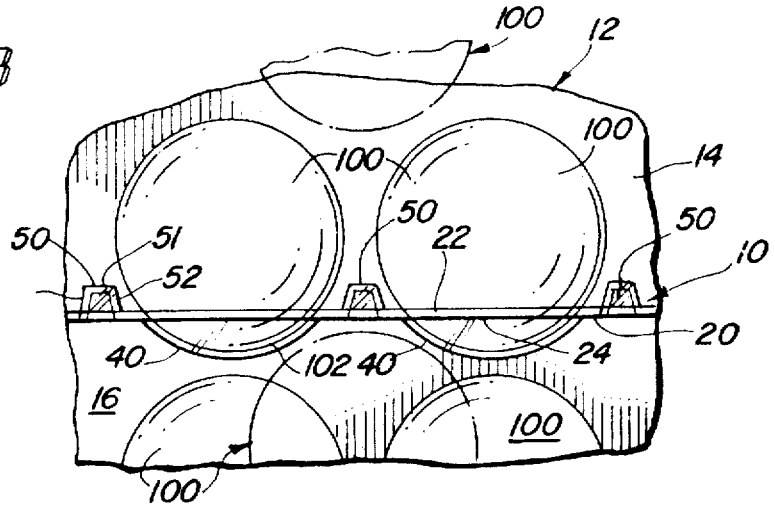
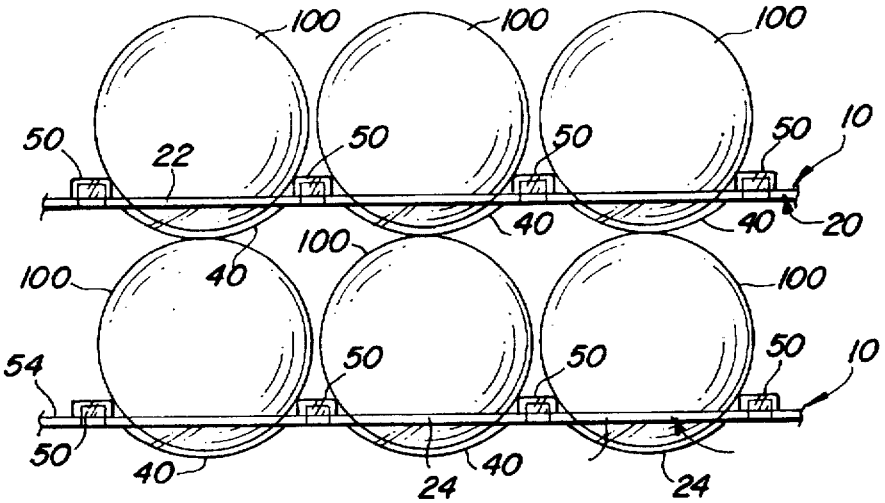
FIG. 5
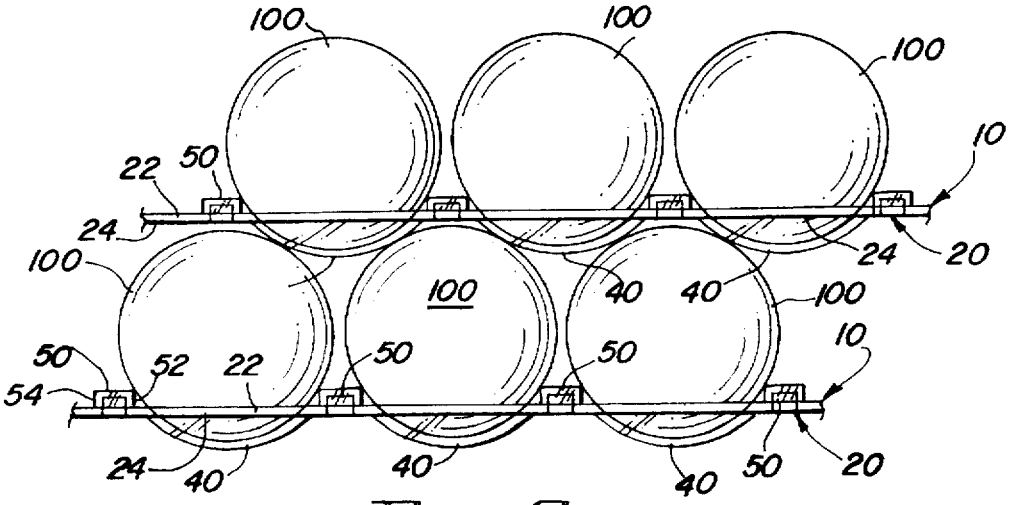
FIG. 6

TRANSPARENT SHELF FOR DISPLAY ASSEMBLY

BACKGROUND OF THE INVENTION

1. Field of the Invention

The present invention relates to display assemblies and, more particularly, to a shelf structure removably attachable to a panel of a display assembly and including a plurality of cradles disposed in spaced relation therealong for supporting objects, such as sports balls, in accordance with a preferred viewing orientation.

2. Description of the Related Art

Display assemblies of various structure are well known in the art. Typically, wall mounted displays include a back panel with shelves or other means for holding objects of display in front of the back panel so that they can be viewed and admired by observers. In some instances, a number of unique items of the some object type are presented in a display assembly of this nature. For instance, it is quite popular to display articles of sports memorabilia in a framed display on a wall. Of particular interest to the present invention are sports ball displays which hold a plurality of a particular type of sports ball, such as a golf ball, baseball, or basketball, in side by side arrangement along one or more horizontal shelves in a display. Display assemblies of this nature typically include a back panel with a series of horizontal, parallel shelves attached to the front face of the back panel and a frame about the periphery of the back panel. The shelves may include means for holding the sports balls in place.

While the various sports ball display assemblies known in the art are generally useful for their intended purpose, namely to hold a plurality of sports balls in an ordered arrangement for display, their structure tends to dominate and/or detract from the visibility of the objects being displayed. For instance, the thickness of the shelves causes the front edge of each shelf to be clearly visible, creating a relatively thick horizontal line below the display objects. Further, a substantial gap is left on opposite sides and above and below each of the display objects (e.g., sports balls).

Since collections tend to get significantly large in quantity, utilizing as much space as possible in a display assembly is highly desirous. In the instance of a sports ball display, it is preferable to allow the balls to touch each other horizontally while only leaving a small gap above and below the balls to accommodate the thickness of the shelf which supports each horizontal row of balls. It is further desirous to minimize the visibility of the front edge of each shelf in the display while maximizing the visible surface area of each ball in the display.

SUMMARY OF THE INVENTION

The present invention is directed to a shelf for use in a display assembly for displaying one or more objects, such as sports balls, wherein the display assembly includes a main panel with a front face having one or more horizontal grooves formed therein. The shelf is formed of a transparent polyvinyl chloride film and includes dish-like cradles disposed at spaced intervals along the top side for holding the objects on the shelf. Transverse reinforcing ribs on opposite sides of each cradle provide strength and rigidity to the shelf. The ribs further provide an increased thickness to the shelf, creating a snug friction fit of a rear peripheral zone within the groove in the back panel, so that the shelf is held in perpendicular relation to the front face of the panel, defining an installed position. With the shelf securely fitted to the panel, objects such as sports balls can be supported within the cradles in a preferred viewing orientation for display. A series of the shelves may be fitted to the main panel, in spaced parallel relation to one another along horizontal rows, in order to display the objects in a dense, vertically aligned or honeycomb stacked arrangement.

OBJECTS AND ADVANTAGES OF THE INVENTION

With the foregoing in mind, it is a primary object of the present invention to provide a shelf structure for a display assembly which is structured and disposed to accommodate a plurality of display objects in a stacked arrangement of horizontal rows in a manner which maximizes the visible surface area of the objects on display.

It is a further object of the present invention to provide a shelf for use in display assemblies having the above advantages and being further structured to utilize as much space as possible within the display to accommodate the display objects in a dense arrangement, thereby minimizing the amount of empty space which remains when the assembly is filled with display objects.

It is still a further object of the present invention to provide a shelf for use in a display assembly wherein the shelf is particularly suited to support a plurality of sports balls in a horizontal row so that the sports ball are maintained in side by side contact with one another along a length of the shelf.

It is yet a further object of the present invention to provide a shelf for holding sports ball in a display and having the advantages as set forth above and further wherein a series of shelves may be installed in the panel of a display assembly in spaced, parallel relation to one another to support sports balls in either a vertically aligned or honeycomb type stacked array.

It is still a further object of the present invention to provide a shelf, as set forth above, wherein the shelf is formed of a relatively thin, transparent ultra-violet resistant polyvinyl chloride film.

It is yet a further object of the present invention to provide a shelf, as set forth above, which can be manufactured by vacuum forming in a vacuum form mold.

It is still a further object of the present invention to provide a shelf, as set forth above, for supporting sports balls of any size including golf balls, baseballs, softballs, and basketballs.

It is still a further object of the present invention to provide a shelf for supporting sports balls in a display assembly wherein the shelf is formed of a transparent material and includes a plurality of dish-like cradles at spaced intervals along its length for holding the balls on the shelf in a manner which allows for maximum visibility of each of the balls, including the lower surface area of each ball seated in the respective cradle.

It is yet a further object of the present invention to provide a shelf for supporting sports balls in a display assembly in a tightly packed, dense arrangement and wherein the shelf is provided with sufficient flexibility to permit easy insertion and removal of individual sports balls within corresponding cradles on the shelf.

These and other objects and advantages of the present invention will be more readily apparent in the following detailed description taken in conjunction with the accompanying drawings.

BRIEF DESCRIPTION OF THE DRAWINGS

For a fuller understanding of the nature of the present invention, reference should be had to the following detailed description taken in conjunction with the accompanying drawings in which:

FIG. 3 is an isolated front elevation of the shelf installed in the back panel of a display assembly with sports balls supported thereon;

FIG. 5 is a front elevation illustrating positioning of two shelves of the present invention in spaced, parallel relation to support sports balls in accordance with a first preferred stacked orientation, wherein the sports balls are aligned vertically in accordance with the arrangement as seen in FIG. 1A; and FIG. 6 is a front elevation of two of the shelves of the present invention shown positioned in spaced, parallel relation to support sports balls in accordance with a second preferred stacked orientation, wherein the sports balls in one horizontal row are offset relative to the sports balls in the adjacent horizontal row in accordance with the honeycomb arrangement as seen in FIG. 1B.

Like reference numerals refer to like parts throughout the several views of the drawings.

DETAILED DESCRIPTION OF THE PREFERRED EMBODIMENT

Figure 1A:
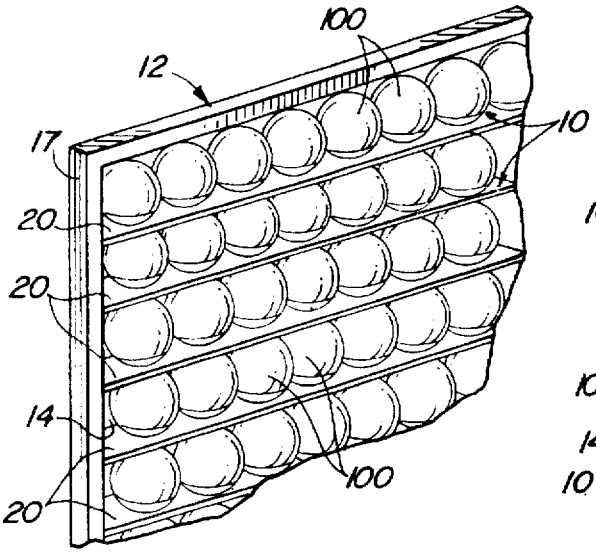
FIG. 1A is a partial perspective view of a sports ball display assembly with the shelf of the present invention installed in a series of horizontal rows to support sports balls therein, in accordance with a first preferred stacked arrangement thereof.
Figure 4:
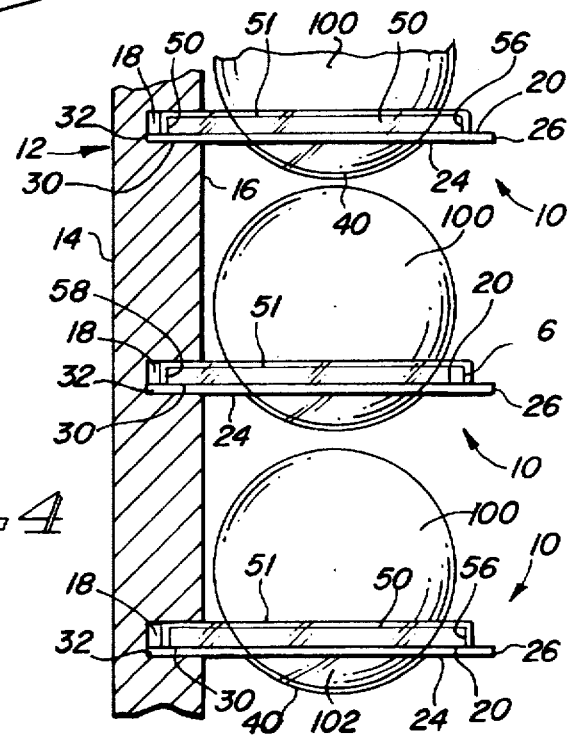
FIG. 4 is a side elevation, in partial section, illustrating a series of shelves of the present invention installed in spaced, parallel relation within grooves in the back panel of a display apparatus with sports balls supported on the shelves.

Referring to the several views of the drawings, and initially FIGS. 1A–4, the shelf is shown and generally indicated as 10. As seen in FIGS. 1A, 1B, and 4, the shelf 10 is designed for use in a display assembly 12 for displaying an arrangement of objects 100, such as sports balls. The display assembly 12 includes a back panel 14 having a front face 16. A frame structure 17 may further be provided about a periphery of the back panel 14 to enhance the overall appearance of the assembly 12. A plurality of grooves 18 are cut into the front face 16 of the back panel 14 and extend horizontally across at least a portion of the width of the panel 14. The grooves 18 are specifically sized and configured to accommodate shelves 10, as described more fully hereinafter.

Figure 2:
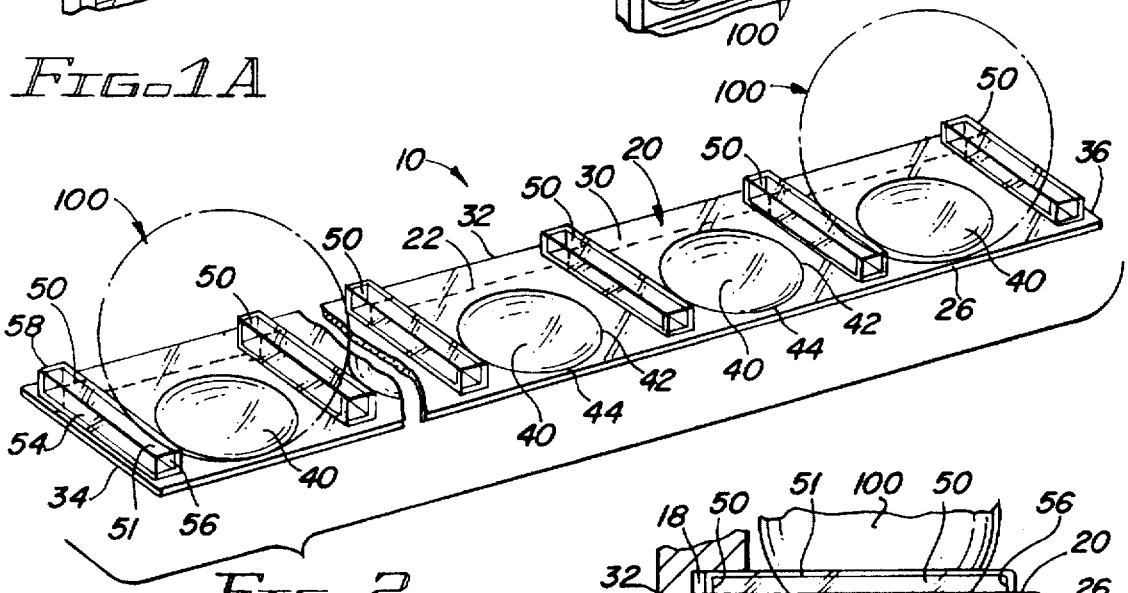
FIG. 2 is a top perspective view of the shelf of the present invention with sports balls supported thereon being indicated by phantom lines.

With particular reference to FIG. 2, the shelf 10 is shown in detail and is characterized primarily by an elongate strip of transparent, ultraviolet resistant plastic material defining a base 20. In a preferred embodiment, the shelf 10 is formed of polyvinyl chloride film having a thickness of approximately 0.025 inches. The shelf base 20 includes a top side 22, a bottom side 24, a front edge 26, and opposite ends 34, 36. The base 20 further includes a rear peripheral edge zone 30, indicated by the broken line in FIG. 2, including a rear edge 32 extending the length of the base 20 between the opposite ends 34, 36.

Figure 1B:
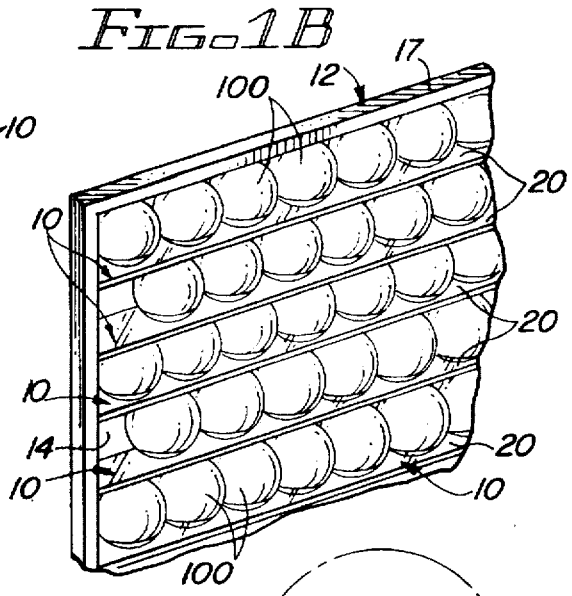
FIG. 1B a partial perspective view of the shelf of the present invention installed in a series of parallel rows in a sports ball display to support a plurality of sports balls therein, in accordance with another preferred stacked arrangement thereof.

As seen in the drawings, the primary purpose of the shelf 10 is to hold a plurality of objects 100, and particularly sports ball (e.g., golf balls, baseballs, softballs, basketballs, etc.), in close, spaced relation along a common horizontal plane. In combination with the display assembly 12, a series of shelves 10 may be used to hold an array of sports ball 100 in parallel, horizontal rows so that the sports balls 100 appear to be stacked vertically either in vertically aligned relation, as seen in FIGS. 1A and 5, or in an offset honeycomb arrangement as seen in FIGS. 1B and 6.

To hold each of the objects 100 in their respective positions on the top surface 22 of the shelf base 20, a series of cradles 40 are provided at equi spaced intervals along a length of the base 20. The cradles 40 are characterized by a dish-shaped concave depression in the top side 22 of the base 20. The dish-shaped depression is surrounded by a generally circular edge 42 having a forward most arc section 44 that is close to being tangent with the front edge 26. To properly hold and position each of the sports balls 100, the circular dish-shaped depression of each cradle 40 should be of a radius generally equal to that of the exterior surface of the sports ball 100. In this manner, the sports balls 100 rest within respective cradles 40 with the outer surfaces of the sports balls conforming with the surface within the cradle 40, as best seen in FIGS. 5 and 6. When the sports balls 100 are seated within the cradles 40, the transparent material of the shelf base 20 permits visibility of a lower portion 102 of each sports ball 100 that is seated within the cradle 40.

The shelf base 20 further includes reinforcing means for providing strength and rigidity to the shelf 10 in order to discourage downward bending or sagging thereof when fitted to the panel, as best seen in FIG. 4. The reinforcing means includes a plurality of transverse rib members 50 disposed in spaced, parallel relation on the base 20 and extending between the front edge 26 and the rear edge 32. The transverse ribs 50 are provided on opposite sides of each of the cradles 40 in spaced relation from the circular edge 42, as best seen in FIG. 2. Each of the transverse ribs 50 includes opposite side walls 52, 54 and a top surface 51. The ribs 50 may also include a front surface 56 and a rear surface 58. In a preferred embodiment, the entire shelf base 20 including the cradles 40 and transverse rib members 50, is molded of the same transparent, ultraviolet resistant plastic material. To form the cradles 40 and transverse rib members 50, the shelf base 20 may be molded by vacuum mold forming techniques or, alternatively, injection molding.

The rib members 50 provide an increased thickness to the shelf base 20 measured between the top surface 51 of the rib members 50 and the bottom side 24 of the base 20. This increased thickness provides a snug fit of the rear peripheral edge zone 30 within a respective groove 18 to releasably hold the shelf base 20 on the panel 14 of the display assembly 12 in perpendicular relation to the front face 16, thereby defining an installed position. To this end, the increased thickness along the peripheral edge zone 30 provides a shelf installation means to hold the shelf 10, and the weight of the objects 100 supported thereon, securely within the display assembly 12.

The back panel 14 may be made of any desired material (e.g., wood, plastic, lucite, aluminum, etc.) and can be cut to any desired shape or size. The thickness of the back panel should be at least twice the depth of the groove 18 to ensure integrity of the back panel 14 so that it can hold the weight of the objects 100 supported on the shelves 10. The vertical spacing of the shelves 10 is dependent upon the size of the objects 100 as well as the desired arrangement. For instance, when displaying regulation size golf balls, the shelves 10 should be spaced at 1¾" measured from the center of each groove 18, when it is desired to display golf balls in vertically aligned relation, as seen in FIG. 5. Alternatively, golf balls can be displayed in a honeycomb like stacked arrangement, as seen in FIG. 6. In this instance, the shelves should be spaced at 1½", measured from the center of each groove 18.

The structure of the shelves 10, and the nature of the transparent material, permits more than one shelf to be fitted within a common horizontal groove 18 on the back panel 14. Thus, the shelves 10 can be butted together, end to end, along the length of a single groove 18. This allows for wall or rack display assemblies to be as wide as necessary or desirous.

While the instant invention has been shown and described in what is considered to be a preferred and practical embodiment thereof, it is recognized that departures may be made within the spirit and scope of the present invention which, therefore, should not be limited except as defined in the following claims under the doctrine of equivalents.

Now that the invention has been described,

What is claimed is:

1. A shelf for use in a display assembly for displaying one or more objects, the assembly including a panel with an exposed front face and at least one groove therein, said shelf comprising:

a base formed of a transparent plastic material and including a top side, a bottom side, a front edge, a rear peripheral edge zone including a rear edge and opposite ends;

cradle means on said top side for holding at least one of the objects so that the object is visibly disposed thereon;

installation means on at least a portion of said rear peripheral edge zone of said base for snug fitted receipt within the groove of the panel to releasably hold said base on the panel of the display assembly in perpendicular relation to the front face of the panel to thereby define an installed position; and reinforcing means on said base for providing strength and rigidity to said base to discourage bending thereof when fitted to the panel in said installed position.

2. A shelf as recited in claim 1 wherein said base is generally elongate and includes a plurality of said cradle means disposed in spaced relation along a length thereof between said opposite ends.

3. A shelf as recited in claim 1 wherein said cradle means includes a dish-like concave depression formed in said top side of said base.

4. A shelf as recited in claim 3 wherein said base is generally elongate and includes a plurality of said dish-like concave depressions disposed in spaced relation along a length thereof between said opposite ends.

5. A shelf as recited in claim 1 wherein said reinforcing means includes transverse rib members extending between said front edge and said rear edge of said base.

6. A shelf as recited in claim 4 wherein said reinforcing means includes transverse rib members extending between said front and said rear edge of said base on opposite sides of each of said dish-like depressions.

7. A shelf as recited in claim 5 wherein said transverse rib members have a greater thickness relative to a remainder of said base measured between said top and bottom sides, said greater thickness of said transverse rib members providing a snug friction fit within the groove of the panel to thereby define said installation means.

8. A shelf as recited in claim 6 wherein said transverse rib members have a greater thickness relative to a remainder of said base measured between said top and bottom sides, said greater thickness of said transverse rib members providing a snug friction fit within the groove of the panel to thereby define said installation means.

9. A shelf for use in a display assembly for displaying one or more objects, the assembly including a panel with an exposed front face and at least one groove therein, said shelf comprising:

a base formed of a transparent plastic material and including a top side, a bottom side, a front edge, a rear peripheral edge zone including a rear edge and opposite ends;

cradle means on said top side for holding at least one of the objects so that the object is visibly disposed thereon, said cradle means including a dish-like concave depression formed in said top side of said base;

installation means on at least a portion of said rear peripheral edge zone of said base for snug fitted receipt within the groove of the panel to releasably hold said base on the panel of the display assembly in perpendicular relation to the front face of the panel to thereby define an installed position; and reinforcing means on said base for providing strength and rigidity to said base to discourage bending thereof when fitted to the panel in said installed position, said reinforcing means including a plurality of transverse rib members extending between said front edge and said rear edge of said base.

10. A shelf as recited in claim 9 wherein said base is generally elongate includes a plurality of said cradle means disposed in spaced relation along a length thereof between said opposite ends.

11. A shelf as recited in claim 10 wherein said transverse rib members are provided on opposite sides of each of said dish-like depressions.

12. A shelf as recited in claim 11 wherein said transverse rib members have a greater thickness relative to a remainder of said base measured between said top and bottom sides, said greater thickness of said transverse rib members providing a snug friction fit within the groove of the panel to thereby define said installation means.

* * * * *